US007184699B2

(12) United States Patent
Naruse et al.

(10) Patent No.: US 7,184,699 B2
(45) Date of Patent: Feb. 27, 2007

(54) CLEANING BLADE FOR IMAGE FORMATION APPARATUS

(75) Inventors: Osamu Naruse, Kanagawa (JP); Masahiko Shakuto, Kanagawa (JP); Hidetoshi Yano, Kanagawa (JP); Kazuhiko Watanabe, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 296 days.

(21) Appl. No.: 10/943,980

(22) Filed: Sep. 20, 2004

(65) Prior Publication Data

US 2005/0100375 A1 May 12, 2005

(30) Foreign Application Priority Data

Sep. 22, 2003 (JP) ..... 2003-329956

(51) Int. Cl.
*G03G 21/00* (2006.01)

(52) U.S. Cl. ..... 399/350

(58) Field of Classification Search ..... 399/159, 399/350, 351

See application file for complete search history.

(56) References Cited

U.S. PATENT DOCUMENTS

| | | | | |
|---|---|---|---|---|
| 4,677,845 | A | 7/1987 | Izumi et al. | |
| 4,772,253 | A | 9/1988 | Koizumi et al. | |
| 4,847,631 | A | 7/1989 | Naruse et al. | |
| 5,051,760 | A | 9/1991 | Shoji et al. | |
| 5,235,384 | A | 8/1993 | Oka et al. | |
| 5,255,059 | A | 10/1993 | Kai et al. | |
| 5,260,754 | A | 11/1993 | Yano et al. | |
| 5,493,365 | A | 2/1996 | Matsui et al. | |
| 5,502,552 | A | 3/1996 | Iwata et al. | |
| 5,598,254 | A | 1/1997 | Ikesue et al. | |
| 5,606,408 | A | 2/1997 | Yano et al. | |
| 5,619,316 | A | 4/1997 | Shoji et al. | |
| 5,638,159 | A | 6/1997 | Kai et al. | |
| 5,740,494 | A | 4/1998 | Shoji et al. | |
| 5,765,087 | A | 6/1998 | Yano et al. | |
| 5,818,482 | A | 10/1998 | Ohta et al. | |
| 5,937,228 | A | 8/1999 | Shoji et al. | |
| 5,999,773 | A | 12/1999 | Yasutomi et al. | |
| 6,366,751 | B1 | 4/2002 | Shakuto et al. | |
| 6,377,779 | B2 * | 4/2002 | Hisakuni | 399/350 |
| 6,560,427 | B2 * | 5/2003 | Kubo et al. | 399/159 |
| 6,625,409 | B2 | 9/2003 | Shakuto et al. | |
| 6,654,579 | B2 | 11/2003 | Shakuto et al. | |
| 6,799,012 | B2 | 9/2004 | Shakuto et al. | |

* cited by examiner

*Primary Examiner*—William J. Royer
(74) *Attorney, Agent, or Firm*—Oblon, Spivak, McClelland, Maier & Neustadt, P.C.

(57) ABSTRACT

A cleaning device and process cartridge including the same for an image formation apparatus, which prevents cleaning failures due to toner slipping past a blade, based on an equation for the force of toner particle rotation and the restraining force. Toner on an image carrier is removed by a blade. The relation between the blade and the image carrier satisfies the equation $f(\theta)=\mu_2-\mu_1\times(N_{tp}/N_{bt}+\cos\theta)>0$. Here $\mu_1$ is the friction coefficient between toner and image carrier, $\mu_2$ is the friction coefficient between toner and blade, $N_{tp}$ is the adhesive force between toner and image carrier, $N_{bt}$ is the force received by the toner from the blade, and $\theta$ is the angle formed by the blade and image carrier (the cleaning angle).

12 Claims, 5 Drawing Sheets

CLEANING BLADE FOR IMAGE FORMATION APPARATUS

BACKGROUND OF THE INVENTION

1. Field of the Invention

This invention relates to an image formation apparatus which utilizes electrophotographic processes, such as a photocopying machine, fax machine, or printer, and in particular relates to a cleaning device used in such an image formation apparatus, and to a process cartridge comprising the same.

2. Description of the Related Art

Advances toward an information-oriented society in recent years have been accompanied by demands for various improvements to and evolution of image formation apparatuses, such as electrophotographic copying machines, fax machines, and printers. These demands have included faster image formation speeds, smaller equipment sizes for more efficient utilization of office space, improved image quality for transmission of high-quality information, and extended equipment lifetimes in the interest of global environmental protection. Consequently, there have been demands for faster, more responsive, smaller, and more durable photosensitive drums and other image carriers used in image formation equipment. In addition, image carriers formed with a coating layer of an organic material, with an inorganic material added to the surface of the organic material, as well as image carriers of amorphous silicon and similar, have also been used in order to extend service lifetimes.

In response to demands for higher image quality, recently it has become clear that the toner which is the developing agent is particularly effective when formed into small-diameter spherical particles. Hence toner with particles in a spherical shape of small diameter is becoming common where toner is being developed and in the marketplace. However, if toner particles are spherical in shape and of small diameter, there is the problem that cleaning of the image carrier surface becomes quite difficult. One well-known cleaning method entails using a brush to electrostatically adsorb toner remaining on the image carrier surface; because of the weak physical impact on the image carrier surface, in recent years this method has been widely adopted.

However, in this brush cleaning method, both positive and negative polarities coexist in the toner due to discharge during the transfer process in image formation; but the polarity of the voltage applied to the brush is the opposite of the toner polarity. Hence in cases where the toner has both polarities, a power supply is necessary which can apply voltages with both polarities, so that an increase in equipment cost is unavoidable. Further, in this brush cleaning method the toner which has been electrostatically captured by the brush must again be removed from the brush, and to this end numerous toner removal means must be provided.

Thus at present, a cleaning method has not yet been developed capable of accommodating a durable image formation apparatus which uses toner having small-diameter particles with a high degree of roundness.

On the other hand, as a method different from the brush cleaning method, a cleaning blade method using a blade member is also well-known, and has been widely adopted due to its simplicity and low cost.

For example, Japanese Patent Laid-open No. 9-292722 discloses an image formation method, characterized in that the electrophotographic photosensitive member is an organic photoconductive photosensitive member; the development process is a process of performing development using toner comprising a release agent with average domain diameter of 0.1 to 1.1 μm; the cleaning process is a process of performing cleaning by bringing a cleaning blade member, with an impact resilience of from 35 to 75%, into contact with the electrophotographic photosensitive member surface at an angle of from 10 to 45° in the counter direction with respect to the rotation direction of the electrophotographic photosensitive member, under a load of 5 to 40 g/cm; and moreover, the electrophotographic photosensitive member surface is processed such that the static friction coefficient of the electrophotographic photosensitive member surface with respect to the cleaning blade member is 1.0 or less.

Further, Japanese Patent Laid-open No. 5-119686 discloses a cleaning device which exhibits satisfactory cleaning performance by satisfying a fixed relation between the cleaning blade Young's modulus E, the cleaning blade thickness t, and the blade protrusion amount L, as characteristic values determining the cleaning angle during a cleaning operation.

Further, Japanese Patent Laid-open No. 2000-330441 discloses an image formation device in which the average volumetric diameter D and average roundness S of the toner particles are used to set a contact force which satisfies prescribed conditions.

Further, Japanese Patent Laid-open No. 2001-66963 discloses an electrophotographic image formation method in which cleaning is performed by causing a rubber blade to vibrate at a maximum vibration amplitude of 10 to 200 μm.

However, in the cases of all of the technologies of the prior art disclosed in the above-described publications, it is difficult to clean toner having spherically-shaped, small-diameter particles on an image carrier using a blade. In actual cleaning, the toner, blade, and image carrier are involved; if the relations between these three members are not sufficiently considered and ascertained, satisfactory cleaning results cannot be obtained. If the blade is simply pressed hard against the surface of the image carrier to form a barrier, hereafter it will be increasingly difficult to accommodate toner particles with smaller diameters.

Further, when using a blade to clean toner, having particles of high roundness and small diameter, remaining on the image carrier, because it is difficult to intercept the toner with the blade, cleaning failures tend to occur. That is, in a mechanism in which cleaning failures occur, when the image carrier moves in a state in which the image carrier and the blade are in contact, the edge portion of the fixed blade is entrained by the image carrier and lifted up. This lifting-up results in a "wedge shape", so that the spherically formed toner particles can easily enter into the gap formed. Hence when one toner particle on the image carrier lifts the blade and passes through, succeeding toner particles also slip past continuously, and so, it is thought, a cleaning failure occurs.

In light of this, the inventors of this invention used a high-speed camera to observe the behavior of toner and the behavior of the blade during blade cleaning, and discovered that the toner particles rotate while slipping past the lower surface of the blade.

SUMMARY OF THE INVENTION

An object of this invention is to provide a cleaning device, and a process cartridge comprising same, for an image formation apparatus enabling satisfactory cleaning which, when performing cleaning using a blade, prevents the slipping-past of toner, taking into account the relation between the force when toner particles are rotating and the force when toner particles are restrained.

In accordance with the present invention, in a cleaning device which employs a blade to remove toner from the surface of an image carrier, the blade and image carrier satisfy the relation $$f(\theta)=\mu_2-\mu_1\times(N_{tp}/N_{bt}+\cos\theta)>0$$

where $\mu_1$ is the friction coefficient between the toner and the image carrier, $\mu_2$ is the friction coefficient between the toner and blade, $N_{tp}$ is the adhesive force between the toner and image carrier, $N_{bt}$ is the force received by the toner from the blade, and $\theta$ is the angle formed by the blade and the image carrier (the cleaning angle).

Further, in a process cartridge, which integrally supports at least an image carrier and cleaning device and which can be removably mounted in an image formation apparatus, the cleaning device comprises a blade which removes toner from the surface of the image carrier, and the blade and image carrier satisfy the relation $$f(\theta)=\mu_2-\mu_1\times(N_{tp}/N_{bt}+\cos\theta)>0$$

where $\mu_1$ is the friction coefficient between the toner and the image carrier, $\mu_2$ is the friction coefficient between the toner and blade, $N_{tp}$ is the adhesive force between the toner and image carrier, $N_{bt}$ is the force received by the toner from the blade, and $\theta$ is the angle formed by the blade and the image carrier (the cleaning angle).

Further, an image formation apparatus comprises an image carrier, which holds a latent image; an electrostatic charging device, which brings an electrostatic charging member into contact or proximity with the image carrier surface and electrostatically charges the image carrier; a latent image formation device, which forms a latent image on the image carrier; a development device, which causes toner to adhere to the latent image of the image carrier and develops; a transfer device, which forms a transfer electric field between the image carrier and an intermediate transfer member and/or recording member in contact with the image carrier while in motion, and which transfers the toner image formed on the image carrier onto the intermediate transfer member and/or recording member; and a cleaning device, which cleans the toner on the image carrier; and wherein the cleaning device comprises a blade which removes toner from the surface of the image carrier, and the blade and image carrier satisfy the relation $$f(\theta)=\mu_2-\mu_1\times(N_{tp}/N_{bt}+\cos\theta)>0$$

where $\mu_1$ is the friction coefficient between the toner and the image carrier, $\mu_2$ is the friction coefficient between the toner and blade, $N_{tp}$ is the adhesive force between the toner and image carrier, $N_{bt}$ is the force received by the toner from the blade, and $\theta$ is the angle formed by the blade and the image carrier (the cleaning angle).

BRIEF DESCRIPTION OF THE DRAWINGS

The above and other objects, features and advantages of the present invention will become more apparent from the following detailed description taken with the accompanying drawings, in which.

DESCRIPTION OF THE PREFERRED EMBODIMENTS

Below, the invention is explained in detail, based on the drawings.

Figure 1:
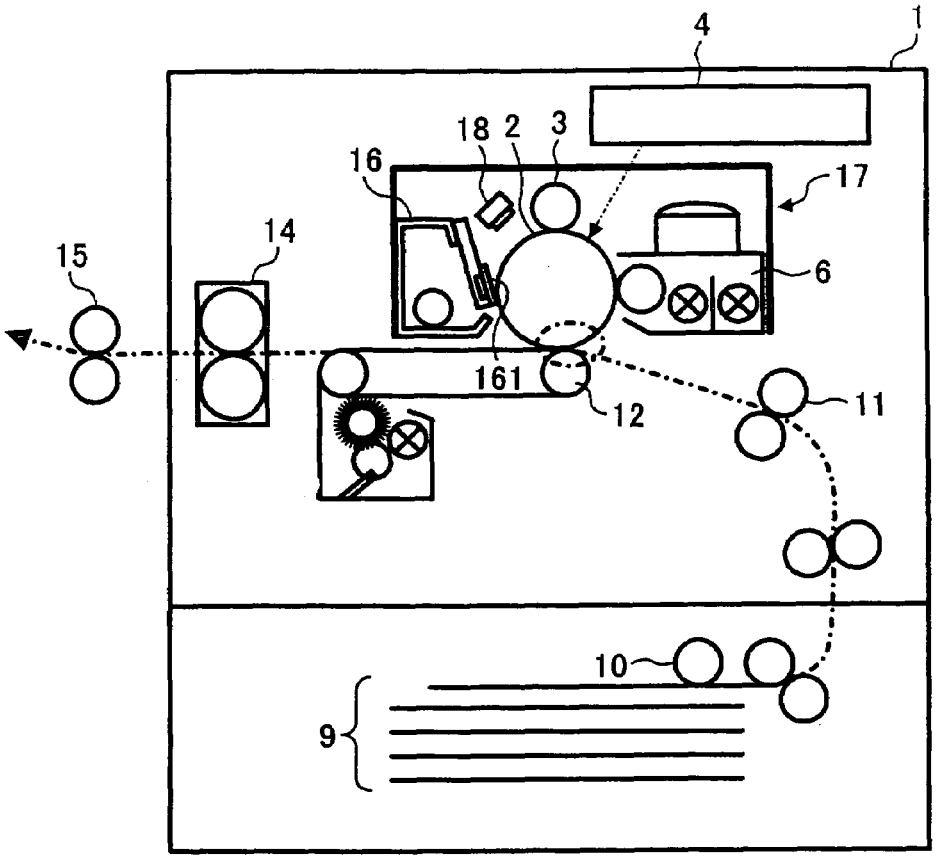
FIG. 1 shows in summary the configuration of an image formation apparatus in which is mounted a cleaning device of this invention.

FIG. 1 shows in summary the configuration of an image formation apparatus 1 in which is mounted a cleaning device 16 of this invention. As shown in the drawing, an electrostatic charging device 3 which electrostatically charges the surface of an image carrier 2 using an electrostatic charging roller or similar means, an exposure device 4 which forms a latent image on the uniformly charged surface of the image carrier 2 using a laser beam or other means, a development device 6 which forms a toner image by causing electrostatically charged toner to adhere to the latent image on the image carrier 2, a transfer device 12 which uses a transfer belt, transfer roller, charger, or similar means to transfer the toner image formed on the image carrier 2 to recording paper, a cleaning device 16 which removes toner remaining on the image carrier 2 after transfer, and a destaticizer 18 which removes the residual electric potential on the image carrier 2, are arranged in order on the periphery of the photosensitive drum which is the image carrier 2.

In such a configuration, an electrostatic latent image is formed by the exposure device 4 on the image carrier 2, the surface of which has been uniformly charged by the electrostatic charging roller of the electrostatic charging device 3, and a toner image is then formed by the development device 6. This toner image is transferred, by the transfer device 12, from the surface of the image carrier 2 to a recording paper conveyed from a paper supply tray 9. Paper feed rollers 10 send recording paper from the paper supply tray 9 to input feed rollers 11, and then to the transfer device 12. The toner image on this recording paper is then fixed to the recording paper by a fixing device 14. Paper from the fixing device 14 is supplied to exit feed rollers 15. On the other hand, toner which has not been transferred but remains on the image carrier 2 is recovered by the cleaning device 16. After removal of the remaining toner, the image carrier 2 is initialized by the lamp of the destaticizer 18, and is then ready for the next image formation process.

Figure 2:
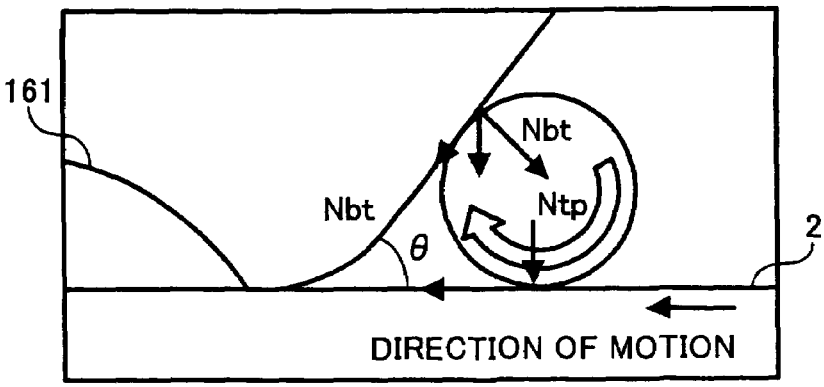
FIG. 2 is a schematic diagram used to explain the relation between the blade and image carrier in the cleaning device.

Next, the relation between a blade 161 in the cleaning device 16 of this invention and the image carrier 2 is explained, referring to FIG. 2. Toner remaining on the image carrier 2 after transfer is intercepted by the blade 161 for cleaning. At this time, the product of the sum of the adhesive force $N_{tp}$ of the toner and the image carrier 2, and the component $N_{bt}\times\cos\theta$ of the repelling force from the blade 161 received by the image carrier 2, that is, of the reaction force from the image carrier 2 felt by a toner particle $(N_{tp}+N_{bt}\times\cos\theta)$, with the friction coefficient $\mu_1$ of the image carrier 2 and the toner particle, acts as a moment to rotate the toner particle in the clockwise direction. This force driving rotation is denoted by F1.

On the other hand, a toner particle receives from the blade 161 a force which impedes rotation. This force, given by the product of the force $N_{bt}$ from the blade 161 and the friction coefficient $\mu_2$ between the blade 161 and toner, acts to cause rotation in the counterclockwise direction. This force, which opposes and impedes rotation in the clockwise direction, is denoted by F2. The cleaning properties of the blade 161 are determined by the relation between these two forces. That is, when F1>F2, toner particles rotate in the clockwise direction and so tend to life up the elastic blade 161. As a result, toner slips past the blade 161, and a cleaning failure results.

However, if F1<F2, the force impeding rotation of toner particles in the clockwise direction is large. Hence there is no force acting to life the blade 161, and so toner does not slip past the blade 161 to result in a cleaning failure. If the relation is rewritten F2−F1>0, then the following is obtained.

$$N_{bt}\times\mu_2-(N_{tp}+N_{bt}\times\cos\theta)\times\mu_1>0 \quad (1)$$

If the relation between the reaction force and adhesive force is normalized, and the result expressed as a function of the angle θ, then the following equation (2) is obtained.

$$f(\theta)=\mu_2-\mu_1\times(N_{tp}/N_{bt}+\cos\theta)>0 \quad (2)$$

Hence by ensuring that the cleaning angle θ of the blade 161, reaction force $N_{bt}$, adhesive force $N_{pt}$, and the friction coefficients $\mu_1$ and $\mu_2$ between the objects in question are related as in the above equation, toner particle rotation can be halted, the lifting-up of the blade 161 by the toner can be suppressed, and cleaning can be performed.

Further, in a cleaning device 16 of this invention, $N_{bt}$ is made larger than $N_{tp}$. Here, $N_{bt}$ is the reaction force felt by the toner from the blade 161; a large value means that when the toner collides with the blade 161, this is the force of the recoil. On the other hand, $N_{tp}$ is the adhesive force between toner and image carrier 2, and consists primarily of two components. The first component is the electrostatic force of attraction of a charged object by an electric field; the second component is the van der Waals force arising from the polarity in molecules of two objects in contact. In equation (2), the cleaning angle θ is taken as a parameter, and in equation (2), $N_{tp}/N_{bt}$ is taken as a parameter; these relations can be illustrated.

Figure 3:
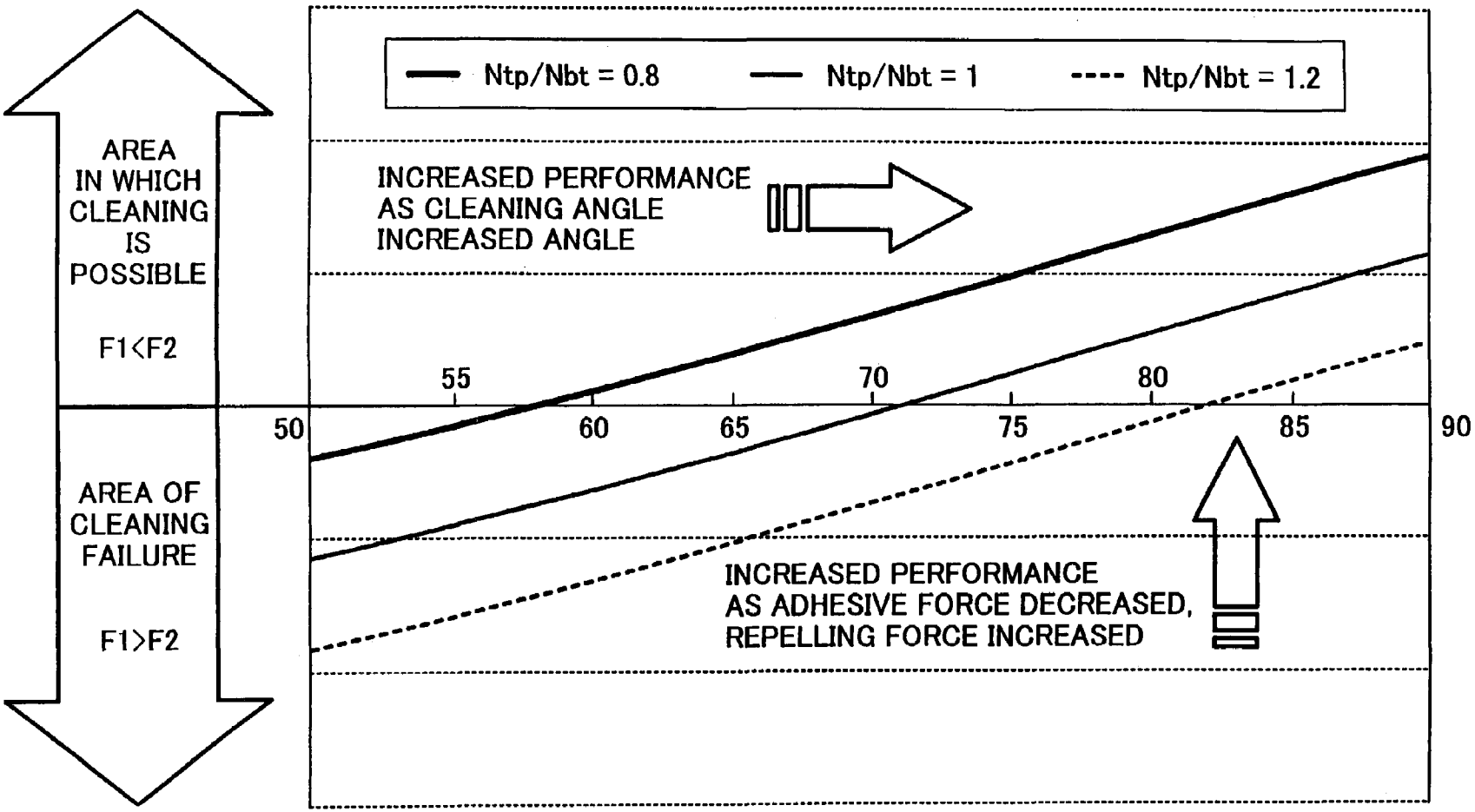
FIG. 3 shows the area in which F1<F2, that is, the area in which cleaning is possible without rotation of spherical toner particles when $f(\theta)>0$, taking $N_{tp}/N_{bt}$ as a parameter.

FIG. 3 shows the area in which F1<F2, that is, the area in which cleaning is possible without rotation of spherical toner particles when f(θ)>0, taking $N_{tp}/N_{bt}$ as a parameter.

Here, the smaller the value of the parameter $N_{tp}/N_{bt}$, the smaller the cleaning angle θ up to which F1<F2. For example, when $N_{tp}/N_{bt}=1$, if θ is not increased to 70° or larger, F1<F2 does not obtain. However, if $N_{tp}/N_{bt}=0.8$, then the relation obtains up to a θ value of 57°, and this provides a margin when setting the initial cleaning angle of the blade 161.

If at this time the angle is set to 70°, a margin with respect to cleaning properties is obtained. Here, specific methods for lowering $N_{tp}$ may be, for example, lowering of the amount of electrostatic charge of the toner, or providing means for removing charge prior to introduction of the blade 161 to reduce the amount of electrostatic charge.

On the other hand, increasing $N_{bt}$ has a similar effect. Specific methods of increasing $N_{bt}$ include increasing the restitution coefficient from the blade 161.

Further, in a cleaning device 16 of this invention, the friction coefficient $\mu_1$ between toner and image carrier 2, and the friction coefficient $\mu_2$ between blade 161 and toner, are designed to be as follows.

First, to prepare the interface between blade 161 and toner, the toner is applied to and developed on a sheet-shape mock image carrier substrate. At this time, the amount of toner adhering is between 0.05 and 0.1 mg/cm$^2$, in consideration of the toner amount typically remaining after transfer. The blade 161 is held in contact and skated over the substrate. If at this time the blade 161 is skated in the counter direction, the toner on the mock image carrier substrate is cleaned and removed, and so the friction coefficient between blade 161 and toner cannot be accurately measured.

In order to eliminate this problem, the blade 161 is skated in the trailing direction. By this means, the toner on the mock image carrier substrate is not removed, and the blade 161 is skated smoothly over the toner surface. As a result, the friction coefficient between the mock image carrier substrate and the face of the blade 161 can be measured. At this time the skating speed is 1 mm/s, and the load applied to the face of the blade 161 is equivalent to the load applied to the blade 161 mounted in an actual electrophotographic apparatus.

In this invention, a load W equivalent to a linear force of 20 to 50 gf/cm is applied. The tensile load F pulling the blade was measured using a strain gauge. These values were used to compute $\mu_2$=F/W. In actuality, by using a HEIDON surface testing device manufactured by Shinto Scientific, the relation between time and friction coefficient can be described on a screen, and the average friction coefficient and other calculations can be performed automatically.

With respect to $\mu_1$, because the image carrier 2 is not an elastic body like the blade 161, plane contact with the toner is not possible. At this time a stainless steel sphere (6 cm in diameter) for surface friction coefficient measurement was used with the HEIDON surface testing device, and the friction coefficient of the image carrier substrate with the stainless steel sphere $\mu_{sp}$ as well as the friction coefficient of the stainless steel sphere and the blade 161 $\mu_{sb}$ were measured. These values can be used together with the previously measured friction coefficient $\mu_2$ between toner and blade 161 ($=\mu_{tb}$) to compute $\mu_1=\mu_{tb}\times\mu_{sp}/\mu_{sb}$.

Figure 4:
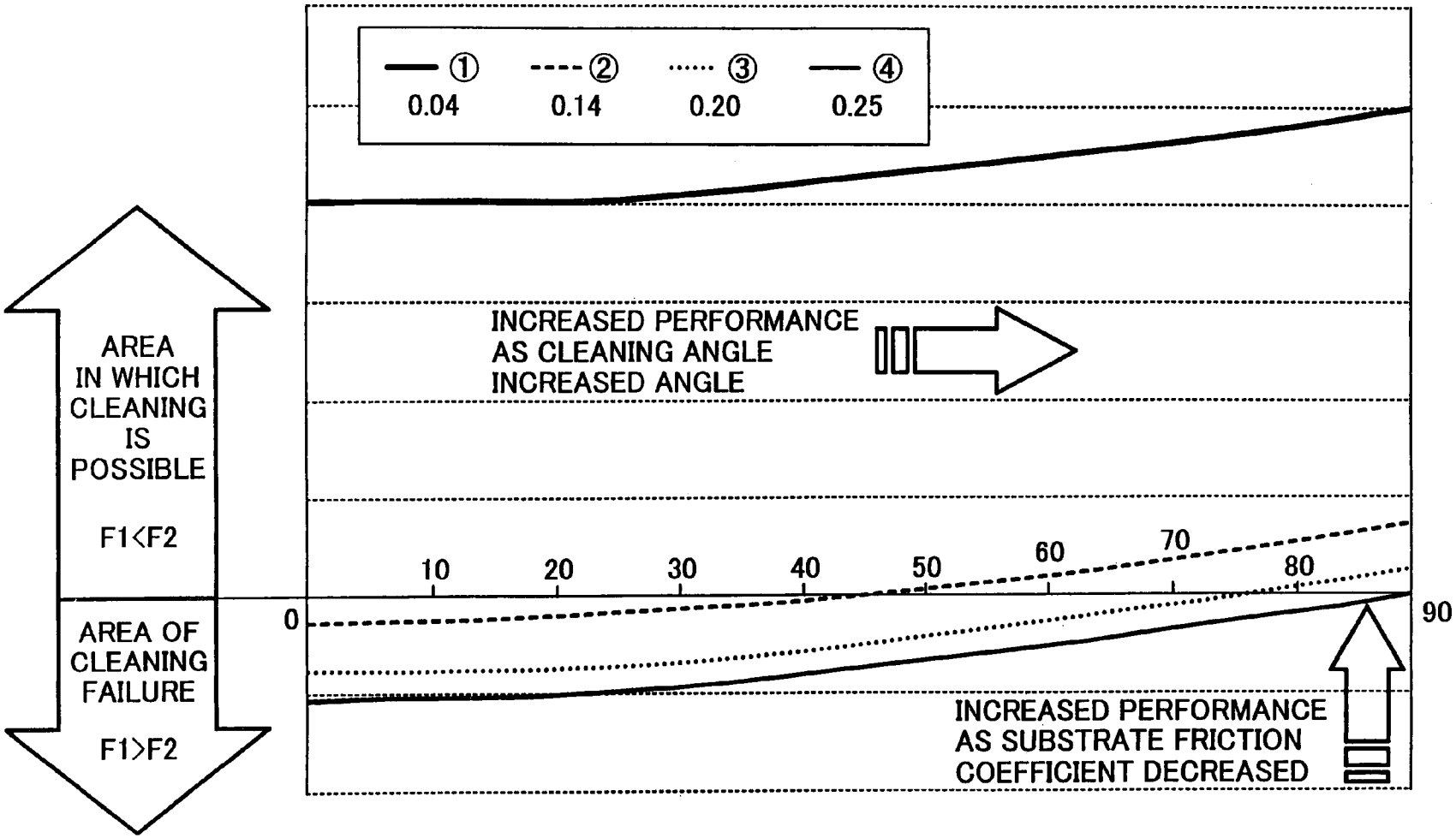
FIG. 4 shows the area in which F1<F2, that is, the area in which cleaning is possible without rotation of spherical toner particles when $f(\theta)>0$, taking $\mu_1$ as a parameter.

FIG. 4 shows the area in which F1<F2, that is, the area in which cleaning is possible without rotation of toner particles when f(θ)>0, taking $\mu_1$ as a parameter. At this time, $\mu_2$ is substantially constant at 0.24 for a blade of polyurethane rubber material, and so it is seen that as $\mu_1$ increases θ increases, and the cleaning margin vanishes. When for example $\mu_1$=0.25, even if θ is 90°, F1<F2 does not obtain, and so cleaning is not possible. At this time, an angle of 90° or greater means that the side face of the blade 161 is in contact with the image carrier 2, that is, the blade belly is in contact, and cleaning is not possible at all.

However, if the value of $\mu_1$ is smaller, the relation F1<F2 begins to obtain from smaller angles. Hence when $\mu_1$=0.04, cleaning is possible at any blade angle.

In recent years, polymerization methods have come to be used in toner production, to conserve energy and raise toner productivity. For the cleaning device of this invention, it is important that the particles of a toner required for high image quality have a particular shape; if the average roundness is less than 0.95, or particles are of irregular shape substantially deviating from spherical, satisfactory transfer properties and high-quality images without dust cannot be obtained. On the other hand, when in cleaning the roundness value is less than 0.95, the rotational forces are small, so that particles can easily be intercepted by the blade 161, without slipping past the blade 161.

As the method of measuring shape, an optical detection method is appropriate in which a suspension comprising the toner particles is passed through an image-capture detection region on a sheet, and a CCD camera is used in optical detection of particle images, which are analyzed. It has been found that a toner with an average particle roundness of 0.95, where the roundness is the circumference of circles equivalent to the projected areas obtained by this method, divided by the circumferences of actual particles, is effective for reproducible formation of finely detailed images with appropriate density. It is still more preferable that the average roundness be from 0.950 to 0.998.

This value can be measured, as an average roundness, using the FPIA-2000 flow type particle image analysis system (manufactured by Toa Medical Electronics). As the specific method of measurement, to 100 to 150 ml of water in a vessel from which impure solids have been removed is added, as a dispersing agent, a surfactant agent, and preferably alkyl benzene sulfonate, in an amount of 0.1 to 0.5 ml; to this is further added 0.1 to 0.5 g of the sample for measurement. A suspension in which the sample is dispersed is subjected to dispersion processing for one to three minutes in an ultrasonic dispersion device, and with a disperse liquid density of 3000 to 10,000 particles/μL, the above equipment is used to measure toner particle shapes and distribution.

Figure 5:
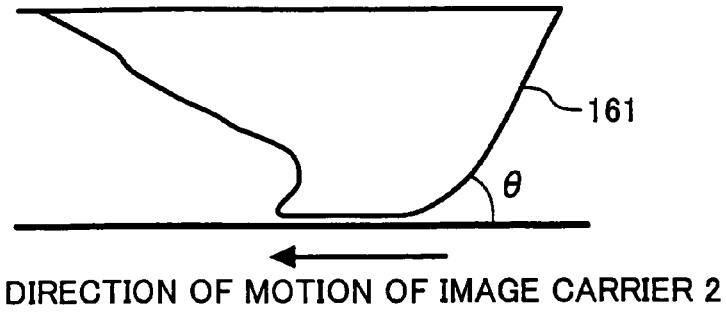
FIG. 5 is a schematic diagram showing the state of the blade being entrained.

In other cases the cleaning properties may be satisfactory, but the blade 161 itself may vibrate with the image carrier 2, resulting in "singing", "buzzing", or other problems. FIG. 5 shows a state in which the blade 161 is entrained. As shown in FIG. 5, when $\theta<45°$ the blade 161 itself is entrained. Through repeated entrainment and rebounding, vibration problems occur, and cleaning failures result. Hence by setting $\theta>85°$, the opposing side of the angle $\theta$ formed by the blade 161 and image carrier 2 becomes small, and the stress with which the blade 161 is pressed against the surface of the image carrier 2 is reduced. This state is generally called a belly contact state, and is a state in which cleaning failures tend to occur. Hence in order to prevent entrainment of the blade 161 and increase the stress, $\theta$ may be made 70° or greater. It is more preferable still that the angle be made less than 80°.

Figure 6:
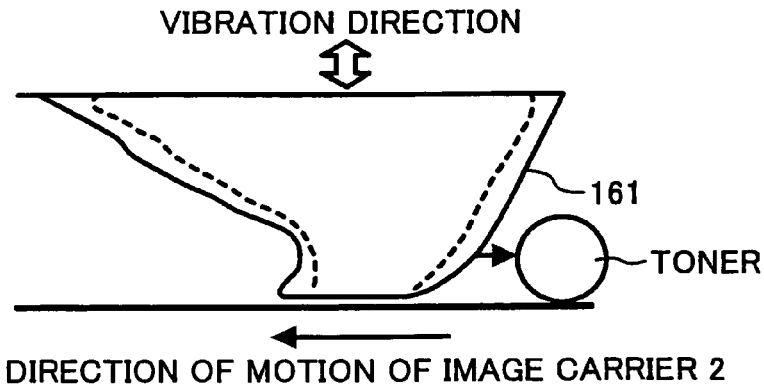
FIG. 6 is a schematic diagram showing the state of the blade rebounding from the image carrier.

In a cleaning device 16 of this invention, the tip of the blade 161 is driven to vibrate by an external driving source. Vibration of the blade 161 itself is added as a means of increasing $N_{bt}$; a repelling force is applied to toner adhering to the blade 161, increasing $N_{bt}$. FIG. 6 shows a state in which the blade 161 is repelled from the image carrier 2. A toner particle, having reached the blade 161, undergoes "breathing" motion in which the particle is pulled toward the position of the dashed line in FIG. 6 by the vertical vibration of the blade 161, and then is returned to the position of the solid line, to amplify $N_{bt}$ for the toner particle. At this time, the amplitude of the blade 161 should be minute, such that the blade is not drawn away from the image carrier 2. In a specific configuration, a piezo element is mounted on the metal sheet supporting the blade 161, and by applying a driving voltage at a frequency of 20 to 40 kHz, the tip portion of the blade 161 vibrates at an amplitude of from 0.1 to 1μm, to obtain a sufficient repelling force.

In a cleaning device 16 of this invention, the impact resilience coefficient is 40% or higher. The toner moves riding on the image carrier 2 due to the force $N_{pt}$, and collides with the wall which is the blade 161. At this time, if the impact resilience coefficient of the wall of the blade 161 is small, the velocity of motion of the image carrier 2 wins out, and an adequate repelling force is not obtained. If the impact resilience coefficient is 40% or less, adequate cleaning properties are not obtained; by raising the coefficient to 40% or higher, cleaning failures can be eliminated. The higher the coefficient, the larger is $N_{pt}$, and the more cleaning properties are improved; but if the value is too large, the repelling force felt by the toner particles becomes too great, and scattering of toner in the cleaning portion tends to occur.

In a cleaning device 16 of this invention, the linear pressure is set to 10 gf/cm or higher and 60 gf/cm or lower. As shown in FIG. 2, the phenomenon of cleaning failure results because toner particles rotate and slip below the lower surface of the blade 161, pressing up on the blade 161 and slipping past. In essence, if equation (2) is satisfied, cleaning failures can be prevented. However, by keeping the blade 161 from being lifted, and keeping it flush with the image carrier 2, the toner is reliably intercepted by the blade 161. At this time, by using a force pressing on the blade 161 of 10 gf/cm or higher, the blade 161 can reliably be held flush with the image carrier 2, and the force of lifting the blade 161 due to toner particle rotation can be opposed. Conversely, if the linear pressure becomes too great, the friction force between the blade 161 and image carrier 2 becomes too great, and the driving force to cause rotation of the image carrier 2 becomes too great, so that problems occur. Also, contact friction between the members causes a decline in reliability and other problems. In order to cope with these problems, the linear pressure of the blade 161 should be set to 60 gf/cm or lower to obtain a margin in the cleaning properties.

Figure 7:
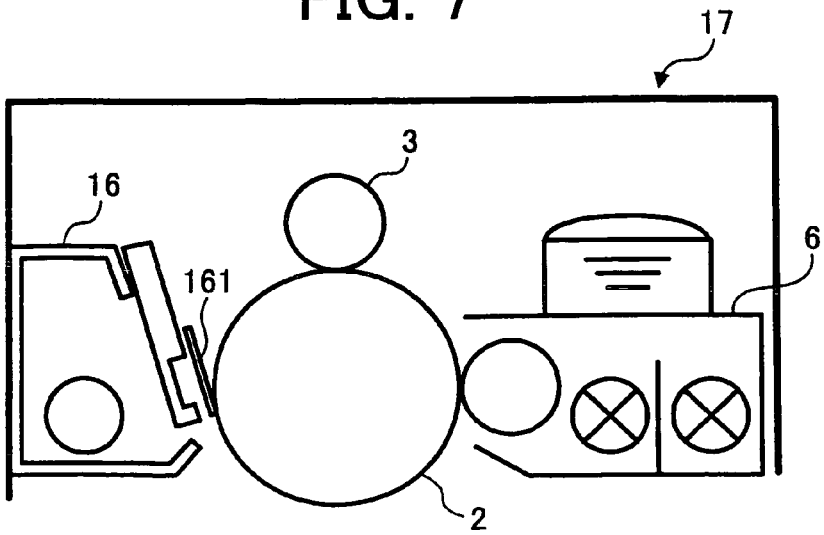
FIG. 7 is a schematic diagram showing the configuration of a process cartridge of this invention; and, FIG. 8 shows in summary the configuration of an image formation apparatus of this invention.

A cleaning device 16 of this invention can be used in a process cartridge 17. FIG. 7 shows the configuration of a process cartridge 17 of this invention. As shown in FIG. 7, an image carrier 2, cleaning device 16 to clean the image carrier 2, electrostatic charging device 3 to charge the image carrier 2, and development device 6 to develop an electrostatic latent image formed on the image carrier 2 using toner, are formed in an integrated construction, to form an engine cartridge which can be removably mounted with integral construction. By this means, the service lifetime of the blade 161 housed within the process cartridge 17 can be extended, and when maintenance becomes necessary, the process cartridge 17 can be replaced, for improved convenience.

Further, a cleaning device 16 of this invention can be mounted in an image formation apparatus. As shown in FIG. 1, a single process cartridge 17 comprising a cleaning device 16 can be mounted. By this means, the toner particle rotation force can be reduced, the slipping of toner past the blade 161 can be prevented, cleaning properties can be improved, and cleaning properties which are stable over a long period can be obtained.

Figure 8:
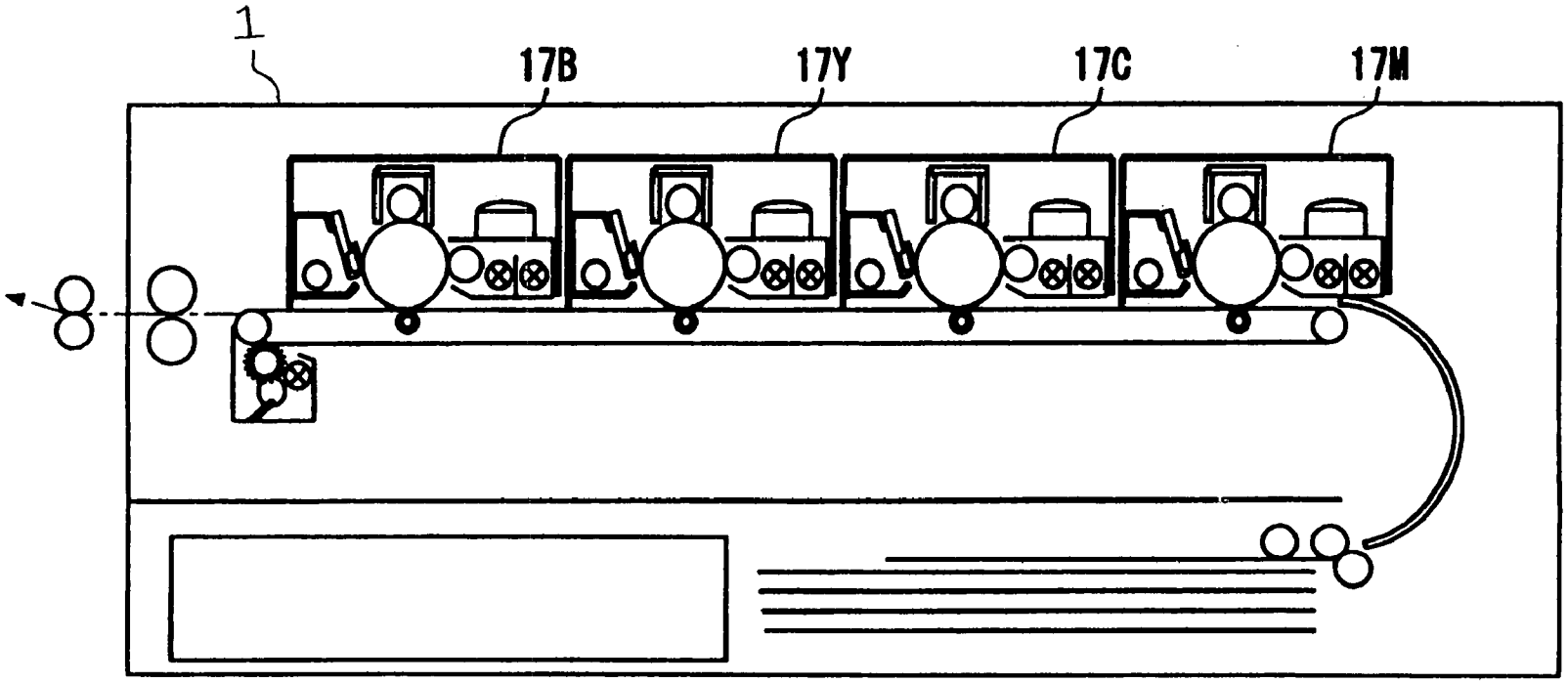

FIG. 8 shows the configuration of an image formation apparatus of this invention. As shown in FIG. 8, in the image formation apparatus 1, a plurality of process cartridges 17M, 17C, 17Y and 17B are mounted, each comprising a cleaning device 16 in which sustained upward-lifting of the blade 161 does not occur. For example, process cartridges 17M, 17C, 17Y and 17B having the primary colors of, from the right, magenta, cyan, yellow, and black, are installed within a single image formation apparatus 1. By this means, when maintenance or similar becomes necessary, a process cartridge 17 need only be replaced, for improved convenience.

By means of the above invention, the following advantageous results are obtained.

(1) The toner particle rotating force can be reduced, to prevent toner from slipping past the blade, so that cleaning properties can be improved, and stable long-term cleaning properties can be obtained.

(2) Even when using toner with smaller-diameter spherical particles, the toner particle rotating force can be reduced, toner can be prevented from slipping past the blade, and cleaning properties can be improved.

(3) The force lifting the blade can be opposed, providing a margin for the cleaning conditions; moreover, wear of the blade and image carrier can be suppressed, for improved durability.

Various modifications will become possible for those skilled in the art after receiving the teachings of the present disclosure, without departing from the scope thereof.

What is claimed is:

1. A cleaning device, which employs a blade to remove toner from the surface of an image carrier, wherein said blade and image carrier satisfy the relation $$f(\theta)=\mu_2-\mu_1\times(N_{tp}/N_{bt}+\cos\theta)>0$$

where $\mu_1$ is the friction coefficient between the toner and the image carrier, $\mu_2$ is the friction coefficient between the toner and blade, $N_{tp}$ is the adhesive force between the toner and image carrier, $N_{bt}$ is the force received by the toner from the blade, and $\theta$ is the angle formed by the blade and the image carrier (the cleaning angle).

2. The cleaning device as claimed in claim 1, wherein the relation between $N_{tp}$ and $N_{bt}$ in said cleaning device is $N_{tp}<N_{bt}$.

3. The cleaning device as claimed in claim 1, wherein the relation between $\mu_1$ and $\mu_2$ in said cleaning device is $\mu_2/\mu_1>1.5$.

4. The cleaning device as claimed in claim 1, wherein the average roundness of particles of said toner is 0.95 or greater.

5. The cleaning device as claimed in claim 1, wherein the angle formed by said blade and image carrier is 70° or greater.

6. The cleaning device as claimed in claim 1, wherein the tip portion of said blade is vibrated by external driving.

7. The cleaning device as claimed in claim 1, wherein the impact resilience coefficient of said blade is 40% or greater.

8. The cleaning device as claimed in claim 1, wherein the linear pressure applied to said blade is greater than or equal to 10 gf/cm, and less than or equal to 60 gf/cm.

9. A process cartridge, which integrally supports at least an image carrier and cleaning device and which can be removably mounted in an image formation apparatus, wherein said cleaning device comprises a blade which removes toner from the surface of the image carrier, and the blade and image carrier satisfy the relation $$f(\theta)=\mu_2-\mu_1\times(N_{tp}/N_{bt}+\cos\theta)>0$$

where $\mu_1$ is the friction coefficient between the toner and the image carrier, $\mu_2$ is the friction coefficient between the toner and blade, $N_{tp}$ is the adhesive force between the toner and image carrier, $N_{bt}$ is the force received by the toner from the blade, and $\theta$ is the angle formed by the blade and the image carrier (the cleaning angle).

10. The process cartridge as claimed in claim 9, wherein said process cartridge comprises a cleaning device which employs a blade to remove toner from the surface of an image carrier, said cleaning device satisfying the relation $$f(\theta)=\mu_2-\mu_1\times(N_{tp}/N_{bt}+\cos\theta)>0$$

where $\mu_1$ is the friction coefficient between the toner and the image carrier, $\mu_2$ is the friction coefficient between the toner and blade, $N_{tp}$ is the adhesive force between the toner and image carrier, $N_{bt}$ is the force received by the toner from the blade, and $\theta$ is the angle formed by the blade and the image carrier (the cleaning angle).

11. An image formation apparatus comprising:

an image carrier, which holds a latent image;

an electrostatic charging device, which brings an electrostatic charging member into contact or proximity with the image carrier surface and electrostatically charges the image carrier;

a latent image formation device, which forms a latent image on the image carrier;

a development device, which causes toner to adhere to the latent image of the image carrier and develops;

a transfer device, which forms a transfer electric field between the image carrier and an intermediate transfer member and/or recording member in contact with the image carrier while in motion, and which transfers the toner image formed on the image carrier onto the intermediate transfer member and/or recording member; and a cleaning device, which cleans the toner on the image carrier; and wherein said cleaning device comprises a blade which removes toner from the surface of the image carrier, and the blade and image carrier satisfy the relation $$f(\theta)=\mu_2-\mu_1\times(N_{tp}/N_{bt}+\cos\theta)>0$$

where $\mu_1$ is the friction coefficient between the toner and the image carrier, $\mu_2$ is the friction coefficient between the toner and blade, $N_{tp}$ is the adhesive force between the toner and image carrier, $N_{bt}$ is the force received by the toner from the blade, and $\theta$ is the angle formed by the blade and the image carrier (the cleaning angle).

12. The image formation apparatus as claimed in claim 11, further comprising at least one process cartridge.

* * * * *